US011421425B2

(12) United States Patent
Markovski et al.

(10) Patent No.: US 11,421,425 B2
(45) Date of Patent: Aug. 23, 2022

(54) JOINING SYSTEM FOR FLOOR PANELS

(71) Applicant: VILOX AB, Helsingborg (SE)

(72) Inventors: Bobby Markovski, Helsingborg (SE); Bengt Rosander; Magnus Persson, Helsingborg (SE)

(73) Assignee: Vilox AB, Helsingborg (SE)

( * ) Notice: Subject to any disclaimer, the term of this patent is extended or adjusted under 35 U.S.C. 154(b) by 0 days.

(21) Appl. No.: 17/052,836

(22) PCT Filed: May 3, 2019

(86) PCT No.: PCT/EP2019/061431

§ 371 (c)(1),
(2) Date: Nov. 4, 2020

(87) PCT Pub. No.: WO2019/211460

PCT Pub. Date: Nov. 7, 2019

(65) Prior Publication Data

US 2021/0262242 A1 Aug. 26, 2021

(30) Foreign Application Priority Data

May 4, 2018 (SE) ..... 1830152-3

(51) Int. Cl.
*E04B 2/00* (2006.01)
*E04F 15/02* (2006.01)

(52) U.S. Cl.
CPC ..... *E04F 15/02038* (2013.01); *E04F 2201/0107* (2013.01); *E04F 2201/0153* (2013.01); *E04F 2201/023* (2013.01); *E04F 2201/043* (2013.01)

(58) Field of Classification Search
CPC ..... E04F 15/02033; E04F 15/02038; E04F 15/107; E04F 15/102; E04F 2201/042;
(Continued)

(56) References Cited

U.S. PATENT DOCUMENTS 6,006,486 A * 12/1999 Moriau ..... E04F 15/04 52/589.1
6,209,278 B1 * 4/2001 Tychsen ..... E04F 15/04 52/592.4
6,216,409 B1 * 4/2001 Roy ..... E04F 13/08 52/588.1

(Continued)

FOREIGN PATENT DOCUMENTS

CN 106856662 A 6/2017
DE 20 2007 013059 U1 11/2007
WO WO 2017/068523 A1 4/2017

OTHER PUBLICATIONS

International Search Report and Written Opinion dated Jun. 27, 2019 in corresponding International Application No. PCT/EP2019/061431.

(Continued)

*Primary Examiner* — Chi Q Nguyen
(74) *Attorney, Agent, or Firm* — Seth Natter; Haug Partners LLP

(57) ABSTRACT

A joining system for floor panels includes a groove and a tongue on opposite floor panel sides. The tongue is shaped for vertical locking engagement with the groove of an adjoining floor panel in a direction perpendicular to the sides of the panels and parallel to a horizontal floor plane. Two locking recesses are formed in a lower portion of the groove. A first recess is located in an internal portion and a second is located in a lip portion. Two locking lugs are formed in a lower portion of the tongue for engagement with the recesses. A first lug extends downwardly from a tip portion of the tongue and a second lug extends downwardly from a root portion. The first recess and the first lug have curved surfaces. The second recess and the second lug have inclined surfaces.

15 Claims, 4 Drawing Sheets

(58) Field of Classification Search
CPC ..... E04F 2201/0107; E04F 2201/03; E04F 2201/0552; E04F 2201/023; E04F 2201/0535; E04F 2201/0146; E04F 2201/043; E04F 2201/0547; E04F 2201/0153; E04F 2201/0138
USPC .. 52/592.1, 592.3, 592.2, 578, 588.1, 309.1, 52/309.3
See application file for complete search history.

(56) References Cited

U.S. PATENT DOCUMENTS 6,711,869 B2 * 3/2004 Tychsen ..... E04F 15/04 52/747.11
6,766,622 B1 * 7/2004 Thiers ..... E04F 15/04 52/591.3
7,093,399 B2 * 8/2006 Thiers ..... E04F 15/10 52/592.1
7,441,384 B2 * 10/2008 Miller ..... E04F 15/04 52/589.1
8,756,899 B2 * 6/2014 Nilsson ..... E04F 15/105 52/747.1
2002/0020127 A1 * 2/2002 Thiers ..... E04F 15/102 52/403.1
2003/0033777 A1 * 2/2003 Thiers ..... E04F 15/20 52/390
2004/0031225 A1 * 2/2004 Fowler ..... B32B 3/02 52/578
2016/0097204 A1 * 4/2016 Meersseman ..... E04F 15/02 52/309.13
2017/0016235 A1 1/2017 Hannig et al.
2020/0232226 A1 * 7/2020 De Rick ..... E04F 15/102

OTHER PUBLICATIONS

Office Action dated Dec. 3, 2021 in corresponding Chinese Application No. 201980029338.0.

* cited by examiner

JOINING SYSTEM FOR FLOOR PANELS

CROSS-REFERENCE TO RELATED APPLICATIONS

This application is the National Stage entry under 35 U.S.C. § 371 of International Application No. PCT/EP2019/061431 filed on May 3, 2019, published on Nov. 7, 2019 under Publication Number WO 2019/211460 A1, which claims the benefit of priority under 35 U.S.C. § 119 of Sweden Patent Application Number 1830152-3 filed on May 4, 2018, the entireties of which are herein incorporated by reference.

TECHNICAL FIELD

The present disclosure relates to joining system for floor panels. The panels have coupling parts including a groove and a tongue, wherein the tongue is inserted into the groove until the panels are joined together with coupling parts in a mutually engaged position.

BACKGROUND

Panels of the type described above and variations thereof are widely used within laminated flooring and prefabricated parquet flooring. A joining system for floor panels of the described type is known from EP 1 338 721 B1. In this joining system, a groove is shaped for insertion of a tongue on an adjoining panel. The tongue is shaped for locking engagement with the groove. The locking engagement is achieved by means of a locking element on the tongue which engages a locking recess or protrusion in a lip portion protruding from an entrance opening of the groove. The coupling parts exert a tension force towards each other in a mutually engaged position, the tension force being delivered by elastic compression of the material of the coupling parts. The joining system according to EP 1 338 721 B1 and its equivalents is a well proven and widely used design which is suitable for most practical floor coverings. The lip portion in this design is arranged to elastically deflect from the plane defined by two adjoining panels when the tongue is inserted into the groove, which allows the two joined panels to flex in relation to each other and thus deviate from the mutual plane if subjected to an external force directed perpendicularly to the individual planes of the panels. A drawback with the known locking system described in EP 1 338 721 B1 is that the elastic deflection of the lip portion required to achieve a sufficient snap-lock effect is rather significant, which causes high stress on the material in the lip portion. This stress is acceptable in dense materials, but may cause breakages in less dense materials which are used in an increasing extent on the world flooring market to save costs in large scale production of floor panels.

SUMMARY

The object of the invention is to provide a joining system for floor panels which solves the problems with prior art as described above, and to offer an improved joining system with an improved locking function and smooth insertion procedure with a minimum of stress to the material of the lip portion during the joining procedure. Hence, the invention relates to a joining system for floor panels, said floor panels being provided with coupling parts on at least two opposite sides for joining floor panels together. The coupling parts include a groove and a tongue, where the groove is shaped for insertion of a tongue on an adjoining floor panel. The tongue is shaped for locking engagement by means of integrated locking means with the groove in a direction perpendicular to said sides and parallel to a horizontal floor plane defined by the joined floor panels. The coupling parts exert a tension force towards each other in a mutually engaged position, said tension force being achieved by elastic compression of the material of the coupling parts.

The invention is especially characterized in that:

- the locking means comprises dual consecutive locking recesses arranged in a lower portion of the groove, a first locking recess of which being located in an internally extending portion within the groove and a second locking recess of which being located in a lip portion (90) protruding from an entrance opening of the groove,
- the locking means further comprises dual consecutive locking lugs arranged in a lower portion of the tongue for horizontally interlocking engagement with said dual consecutive locking recesses in the groove, a first locking lug of which extending downwardly from a lower tip portion of the tongue and a second locking lug of which extending downwardly from a root portion of the tongue,
- wherein the first locking recess and the first locking lug are provided with matching curved horizontal locking surfaces and
- wherein the second locking recess and the second locking lug are provided with matching inclined horizontal locking surfaces.

In an advantageous embodiment of the invention an intermediate transitional ridge between the first locking lug and the second locking lug is located inside of an entrance opening of the groove, said entrance opening being located in a main vertical joint plane between two joined panels.

According to an alternative beneficial embodiment of the invention, an intermediate transitional ridge between the first locking lug and the second locking lug is aligned with the entrance opening of the groove, said entrance opening being located in a main vertical joint plane between two joined panels.

In an advantageous embodiment of the invention, the tip portion of the tongue is curved. Preferably, the curvature of the curved lower tip portion of the tongue merges continuously with a corresponding curvature of the horizontal locking surface of the first locking lug.

In a beneficial embodiment of the invention, the first locking recess is shallower than the second locking recess. The depth of the first locking recess is less than half of the depth of the second locking recess.

According to a favourable embodiment of the invention, an exit tangent inclination angle of the curved horizontal locking surface of the first locking recess is less than the inclined locking angle of the second locking recess. Preferably said exit tangent inclination angle (A) is equal to or less than half the inclined locking angle of the second locking recess.

Advantageously, the curved horizontal locking surface extends from a point located essentially directly below a radial center of the curved first locking recess in a direction towards the second locking recess.

In a well-functioning embodiment of the invention, the height of the intermediate transitional ridge measured from a bottom plane of the floor panel is equal to or less than the corresponding height of a corresponding inlet ridge of the second locking recess.

In a preferred embodiment of the invention the length of a vertical locking surface of the tongue is less than the corresponding length of a matching vertical locking surface of the groove.

Preferably, the minimum thickness between the first locking recess and a bottom plane of the floor panel exceeds a third of the total height of the floor panel.

In a beneficial embodiment of the invention the introduction angle of the groove is equal to or greater than 10 degrees.

Preferably the length of the internally extending portion within the groove is less than the length of the lip portion protruding from an entrance opening of the groove.

The dual consecutive locking recesses and the matching dual consecutive locking lugs makes the mechanical locking function of the joining system stronger than known joining systems with single locking recesses and locking lugs. The dual locking horizontal function also enables the use of more shallow locking recesses which leaves room beneath the locking recesses for a thicker and more robust lower portion of the groove. This aspect is important for floor panels made of inherently brittle and less dense materials as often used in large scale serial production of floor panels.

It should be emphasized that the term comprises/comprising or includes when used in this specification is taken to specify the presence of stated features, integers, steps or components but does not preclude the presence or addition of one or more other features, integers, steps, components or groups thereof.

Further advantages and advantageous features of the invention are disclosed in the following description and in the appended claims.

BRIEF DESCRIPTION OF THE DRAWINGS

These and other aspects, features and advantages of which embodiments of the invention are capable of will be apparent and elucidated from the following description of embodiments of the present invention, reference being made to the accompanying drawings, in which.

DETAILED DESCRIPTION OF EXAMPLE EMBODIMENTS OF THE INVENTION

Figure 1:
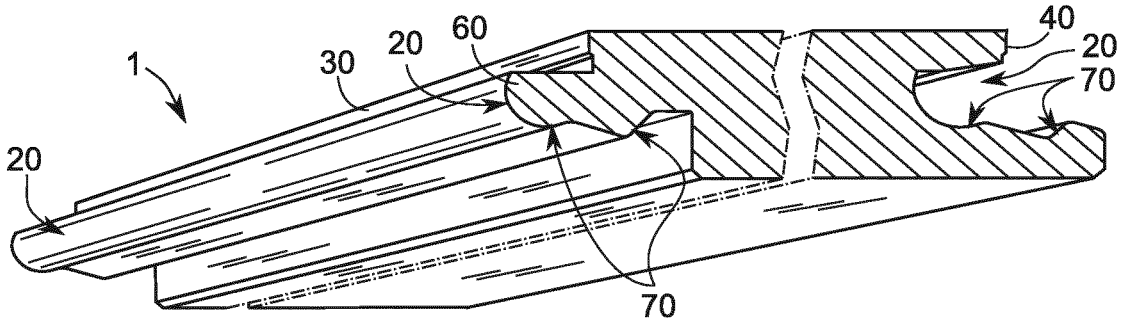
FIG. 1 is a broken perspective- and cross-sectional view of a typical floor panel according to a first embodiment the present invention, showing the coupling parts on each long side of the floor panel. The cross-sectional view is taken along a cross-section I-I of a floor panel shown in the following FIG. 2.

Specific embodiments of the invention will now be described with reference to the accompanying drawings. This invention may, however, be embodied in many different forms and should not be construed as limited to the embodiments set forth herein; rather, these embodiments are provided so that this disclosure will be thorough and complete, and will fully convey the scope of the invention to those skilled in the art. The terminology used in the detailed description of the embodiments illustrated in the accompanying drawings is not intended to be limiting of the invention. In the drawings, like numbers refer to like elements.

FIG. 1 is a broken perspective- and cross-sectional view of a typical floor panel 1 according to a first embodiment the present invention, showing coupling parts 20 on each long side LS of the floor panel 1. The cross-sectional view is taken along a cross-section I-I of a floor panel 1 shown in the following FIG. 2. In the joining system the floor panels 1 are provided with coupling parts 20 on at least two opposite sides 30, 40 for joining floor panels 1 together. The coupling parts 20 include a groove 50 and a tongue 60, where the groove 50 is shaped for insertion of a tongue 60 on an adjoining floor panel 1.

Figure 2:
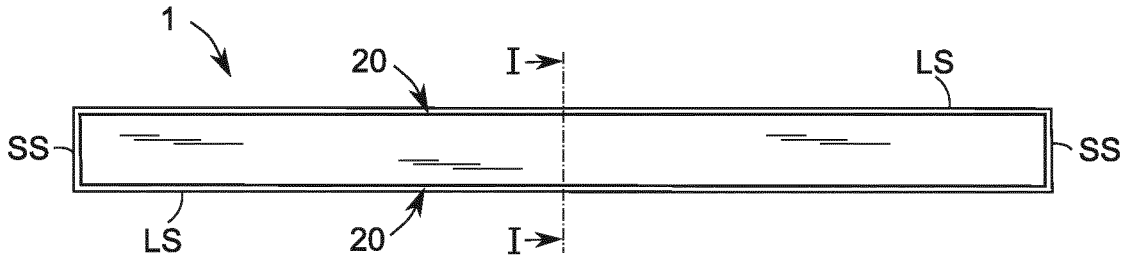
FIG. 2 is a simplified top view of a floor panel according to the invention, showing coupling parts on the long sides of the floor panel as well as on the short sides of a typical floor panel.

FIG. 2 is a simplified top view of a floor panel 1 according to the invention, showing coupling parts 20 on the long sides LS of the floor panel 1 as well as on the short sides SS of a typical floor panel 1.

Figure 3:
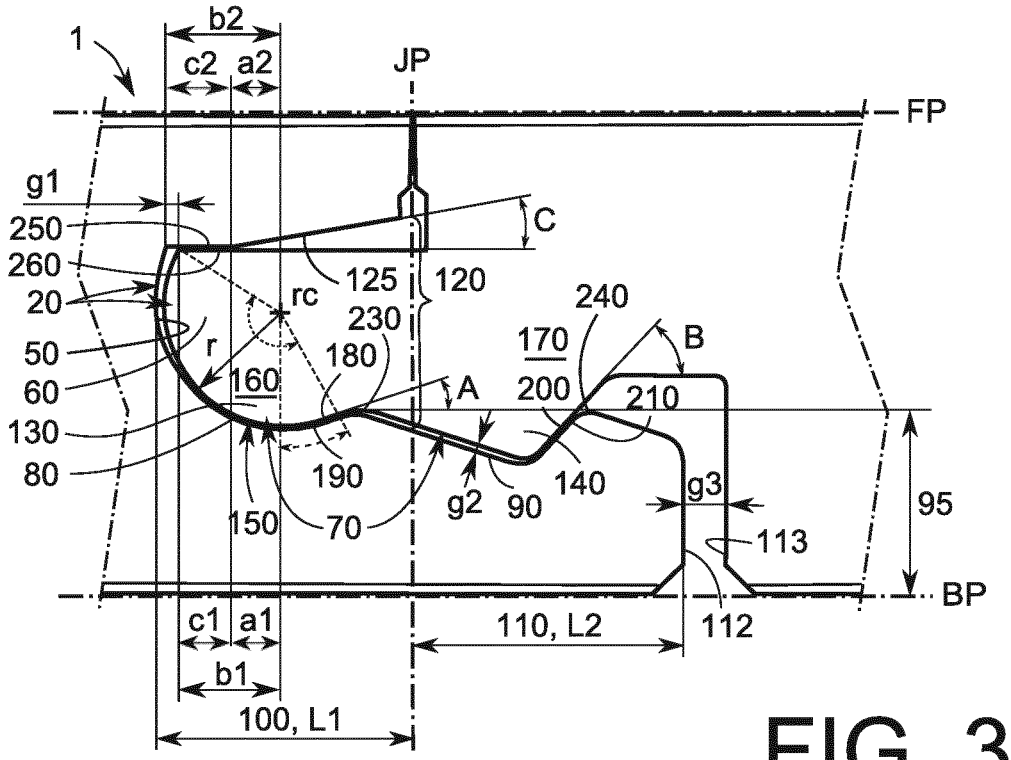
FIG. 3 is an enlarged, side view of two joined floor panels of the type previously shown in FIG. 1. The figure is drawn with emphasized contour lines and without cross-sectional markings for the sake of clarity.

In FIG. 3 the joining system according to the invention is illustrated in an enlarged, side view of two joined floor panels 1 of the type previously shown in FIGS. 1 and 2. The figure is drawn with emphasized contour lines and without cross-sectional markings for the sake of clarity. The tongue 60 is shaped for locking engagement by means of integrated locking means 70 with the groove 50 in a direction perpendicular to said sides 30, 40 and parallel to a horizontal floor plane FP defined by the joined panels 1, as shown in FIG. 3.

The coupling parts 20 exert a tension force towards each other in a mutually engaged position, the tension force being achieved by elastic compression of the material of the coupling parts 20. Unique features of the invention include:

- the locking means 70 comprises dual consecutive locking recesses 80, 90 arranged in a lower portion of the groove 50, a first locking recess 80 of which being located in an internally extending portion 100 within the groove 50 and a second locking recess 90 of which being located in a lip portion 110 protruding from an entrance opening 120 of the groove 50,
- the locking means 70 further comprises dual consecutive locking lugs 130, 140 arranged in a lower portion 150 of the tongue 60 for horizontally interlocking engagement with said dual consecutive locking recesses 80, 90 in the groove 50, a first locking lug 130 of which extending downwardly from a lower tip portion 160 of the tongue 60 and a second locking lug 140 of which extending downwardly from a root portion 170 of the tongue 60,
- wherein the first locking recess 80 and the first locking lug 130 are provided with matching curved horizontal locking surfaces 180, 190 and
- wherein the second locking recess 90 and the second locking lug 140 are provided with matching inclined horizontal locking surfaces 200, 210.

The dual consecutive locking recesses 80, 90 and the matching dual consecutive locking lugs 130, 140 makes the mechanical locking function of the joining system stronger than known joining systems with single locking recesses and locking lugs. The dual locking horizontal function also enables the use of more shallow locking recesses which leaves room beneath the locking recesses for a thicker and more robust lower portion 95 of the groove 50. This aspect is important for floor panels 1 made of inherently brittle and less dense materials as often used in large scale serial production of floor panels.

The extension of the matching curved horizontal locking surfaces 180, 190 of the first locking recess 80 and the first locking lug 130 is illustrated in FIG. 3 as a sector drawn with dashed lines as well as a dashed sector angle arrow below the actual horizontal locking surfaces 180, 190. By the term horizontal locking surfaces is here meant locking surfaces intended to lock the floor panels 1 together in a horizontal direction, i.e. the direction of the floor plane FP and the parallel bottom plane BP as indicated in the figure. Thus, the horizontal locking surfaces 180, 190 are not horizontal per se, but instead exhibit the curved shape shown in the figures.

As is further shown in FIG. 3, an intermediate transitional ridge 230 is located between the first locking lug 130 and the second locking lug 140 inside of the entrance opening 120 of the groove 50. As illustrated in the figure, the entrance opening 120 is more particularly located in a main vertical joint plane JP between two joined floor panels 1.

An important feature of the invention is that the lower tip portion 160 of the tongue 60 is curved, which greatly facilitates insertion of the tongue 60 into the groove 50. The curvature of the curved lower tip portion 160 merges continuously with a corresponding curvature of the horizontal locking surface 190 of the first locking lug 130.

In order to ensure an easy access for the tongue during the joining procedure, the introduction angle C of the groove 50 is equal to or greater than 10 degrees. Said introduction angle C is defined as the inclination of an inclined introduction guiding chamfer 125, as illustrated in FIG. 3.

As demonstrated in FIG. 3, an exit tangent inclination angle A of the curved horizontal locking surface 180 of the first locking recess 80 is less than the inclined locking angle B of the second locking recess 90. Preferably, the exit tangent inclination angle A is equal to or less than half the inclined locking angle B of the second locking recess 90.

The curved horizontal locking surface 180 extends from a point located essentially directly below a radial center rc of the curved first locking recess 80 in a direction towards the second locking recess 90.

In FIG. 3, tolerance gaps g1, g2 and g3 facilitate production of the joining system. Tolerance gap g1 is formed between the tip of the tongue 60 and the groove 50. Tolerance gap g2 is formed between the second locking recess 90 and the second locking lug 140 on the left side—as shown in FIG. 3—of the matching inclined locking surfaces 200, 210. Finally, a tolerance gap g3 is formed between a distal end surface 112 of the lip portion 110 of the left floor panel 1 in FIG. 3 and an adjacent lower end surface 113 of the adjoining floor panel 1 shown to the right in FIG. 3.

As further demonstrated in FIG. 3, the length L1 of the internally extending portion 100 within the groove 50 is less than the length L2 of the lip portion 110 protruding from an entrance opening 120 of the groove 50. This feature ensures a robust joining system with improved strength compared to joining systems where the groove 50 is deeper and the tongue is longer than in the proposed joining system.

The length c1 of a vertical locking surface 250 of the tongue 60 is less than the corresponding length c2 of a matching vertical locking surface 260 of the groove 50. This relationship is demonstrated by the dimensions a1, b1, c1 and a2, b2, c2 illustrated with dimension arrows in FIG. 3. Hence $c1=b1-a1<c2=b2-a2$.

Figure 4:
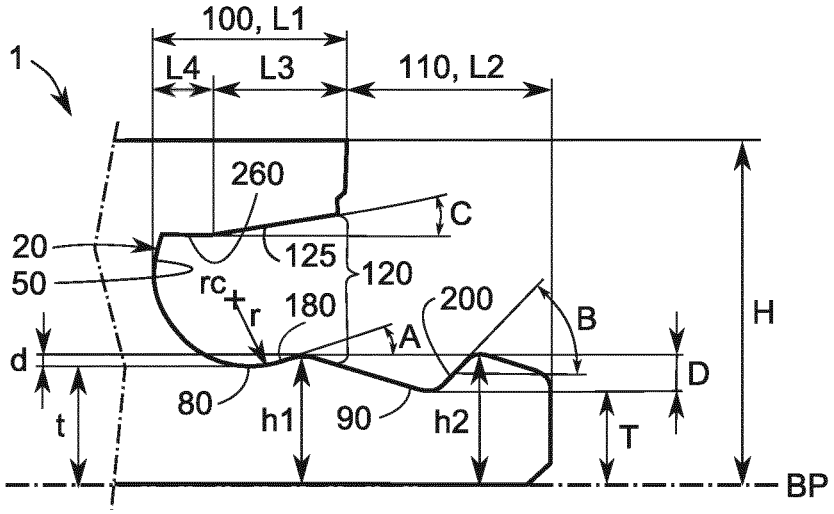
FIG. 4 is a simplified side view of a floor panel demonstrating the profile contours of the groove according to the first embodiment of the invention as previously shown in FIGS. 1 and 3. Again, the figure is drawn with emphasized contour lines and without cross-sectional markings for the sake of clarity.

FIG. 4 is a simplified side view of a floor panel demonstrating the profile contours of the groove according to the first embodiment of the invention as previously shown in FIGS. 1 and 3. Again, the figure is drawn with emphasized contour lines and without cross-sectional markings for the sake of clarity. As shown in the figure, the first locking recess 80 is shallower than the second locking recess 90. In the shown embodiment, the depth d of the first locking recess 90 is less than half of the depth D of the second locking recess 90. Furthermore, the height h1 of the intermediate transitional ridge 230 measured from a bottom plane BP of the floor panel 1 is equal to or less than the corresponding height h2 of a corresponding inlet ridge 240 of the second locking recess 90. The minimum thickness t between the first locking recess 80 and a bottom plane BP of the of the floor panel 1 exceeds a third of the total height H of the floor panel 1.

Figure 5:
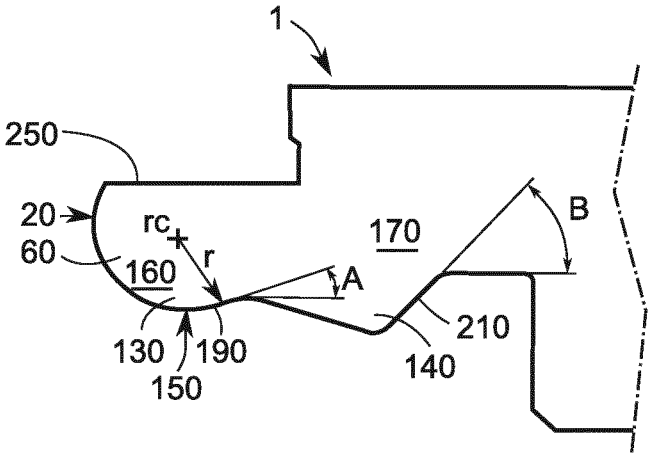
FIG. 5 is a simplified side view of a floor panel demonstrating the profile contours of the tongue according to the first embodiment of the invention as previously shown in FIGS. 1 and 3. Again, the figure is drawn with emphasized contour lines and without cross-sectional markings for the sake of clarity.

FIG. 5 is a simplified side view of a floor panel demonstrating the profile contours of the tongue 60 according to the first embodiment of the invention as previously shown in the preceding FIGS. 1-4. Again, the figure is drawn with emphasized contour lines and without cross-sectional markings for the sake of clarity.

Figure 6:
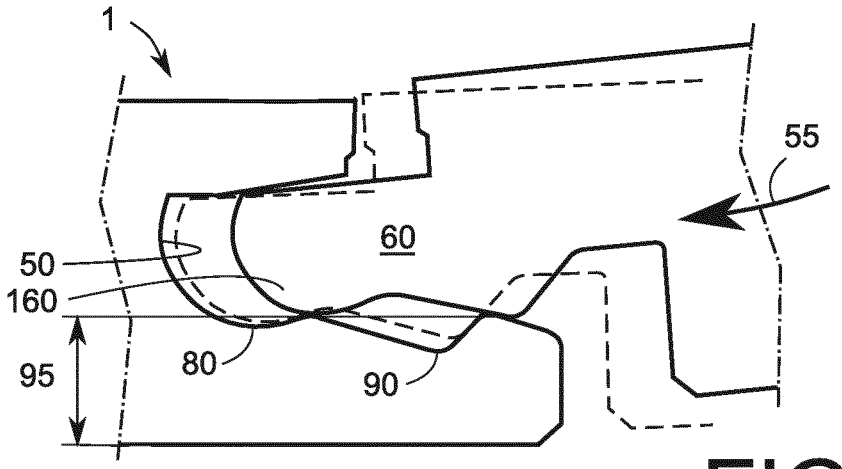
FIG. 6 is a simplified side view of two adjoining floor panels of the type previously shown in the previous figures, showing angled insertion of the tongue into the groove. An intermediate position of the tongue is drawn with dashed lines. Again, the figure is drawn with emphasized contour lines and without cross-sectional markings for the sake of clarity.

FIG. 6 is a simplified side view of two adjoining floor panels 1 of the type previously shown in the previous figures, showing angled insertion of the tongue 60 into the groove 50, as indicated with the curved arrow 55. An intermediate position of the tongue is drawn with dashed lines. Again, the figure is drawn with emphasized contour lines and without cross-sectional markings for the sake of clarity. The angled insertion is greatly facilitated by the smooth gradual engagement of the curvature of the rounded lower tip portion 160 of the tongue 60, resulting in little or no deflection of the lower lip portion 95 of the groove 50.

Figure 7:
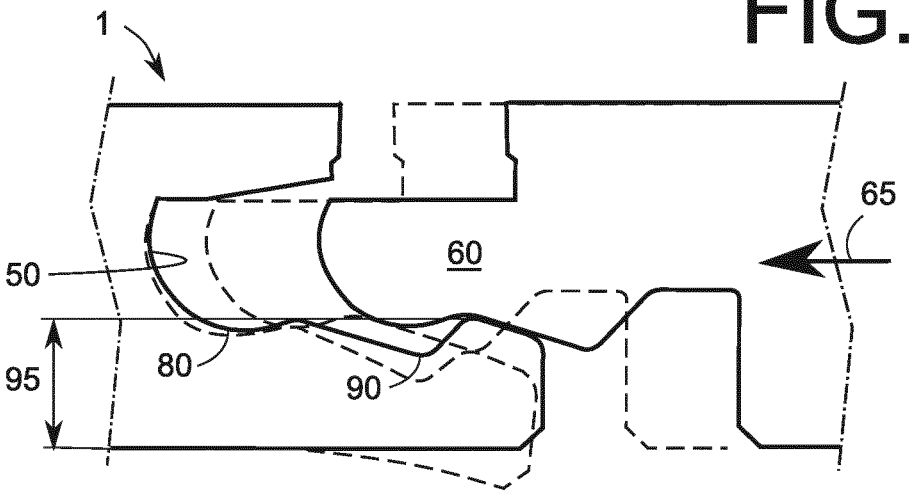
FIG. 7 is a simplified side view of two adjoining floor panels of the type previously shown in the previous figures, showing an optional straight horizontal insertion of the tongue into the groove. An intermediate position of the tongue is drawn with dashed lines as is the deflection of the lower lip portion of the groove. Again, the figure is drawn with emphasized contour lines and without cross-sectional markings for the sake of clarity.

FIG. 7 is a simplified side view of two adjoining floor panels of the type previously shown in the previous figures, showing an optional straight horizontal insertion of the tongue 60 into the groove 50, as indicated with the curved arrow 65. An intermediate position of the tongue is drawn with dashed lines as is the deflection of the lower lip portion 95 of the groove 50. Again, the figure is drawn with emphasized contour lines and without cross-sectional markings for the sake of clarity. The straight horizontal insertion requires a higher insertion force when joining the floor panels 1 and results in a marked deflection of the lower lip portion 95 of the groove 50, as indicated by the dashed lines.

Figure 8:
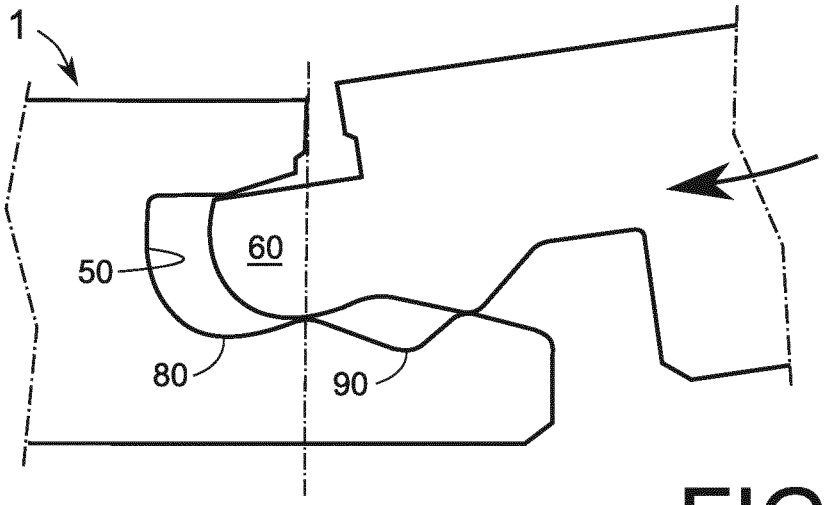
FIG. 8 is a simplified side view of a floor panel demonstrating the profile contours of the tongue according to a second, optional embodiment of the invention. The figure is drawn with emphasized contour lines and without cross-sectional markings for the sake of clarity.

FIG. 8 is a simplified side view of a floor panel 1 demonstrating the profile contours of the tongue 60 according to a second, optional embodiment of the invention. The figure is drawn with emphasized contour lines and without cross-sectional markings for the sake of clarity. In this embodiment, the intermediate transitional ridge 230 between the first locking recess 80 and the second locking recess 90 is aligned with the entrance opening 120 of the groove 50.

Figure 9:
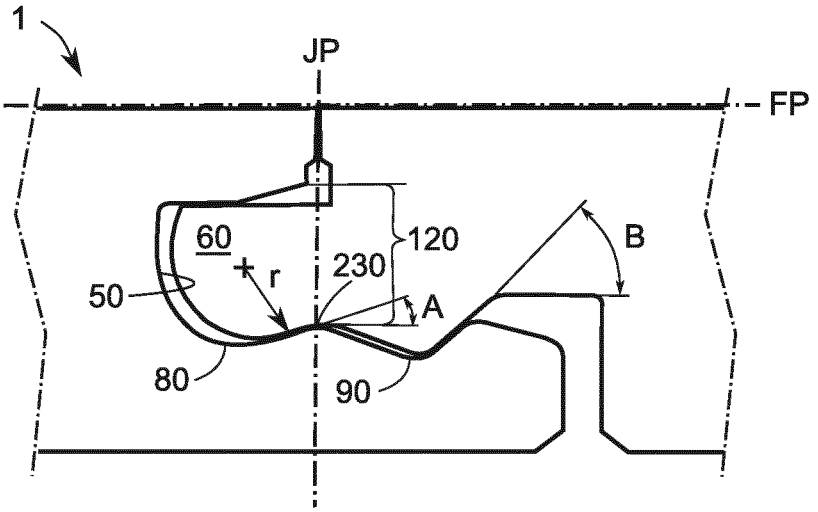
FIG. 9 is a side view of two joined floor panels of the second embodiment as previously shown in FIG. 8. The figure is drawn with emphasized contour lines and without cross-sectional markings for the sake of clarity.

FIG. 9 is a side view of two joined floor panels 1 of the second embodiment as previously shown in FIG. 8. The figure is drawn with emphasized contour lines and without cross-sectional markings for the sake of clarity.

Figure 10:
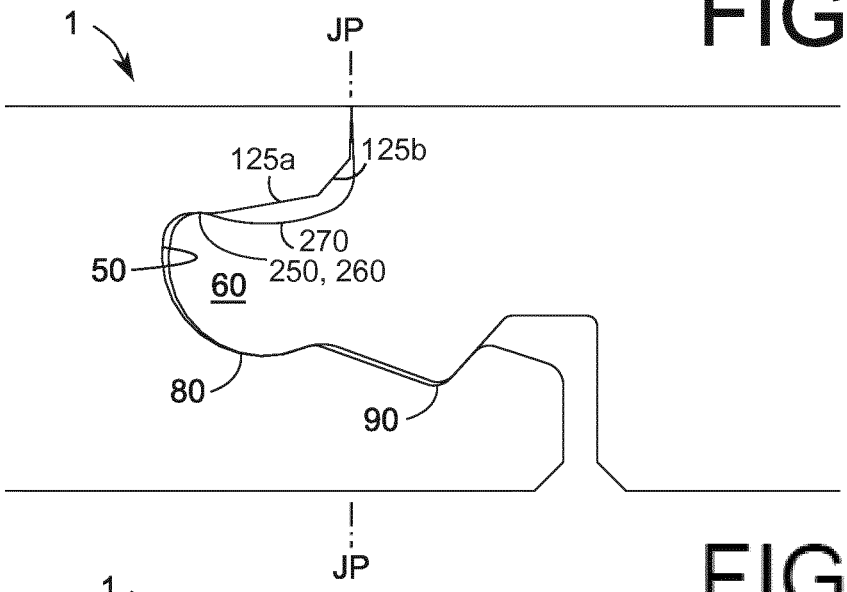
FIG. 10 is a side view of two joined floor panels of a third optional embodiment of the invention.
Figure 11:
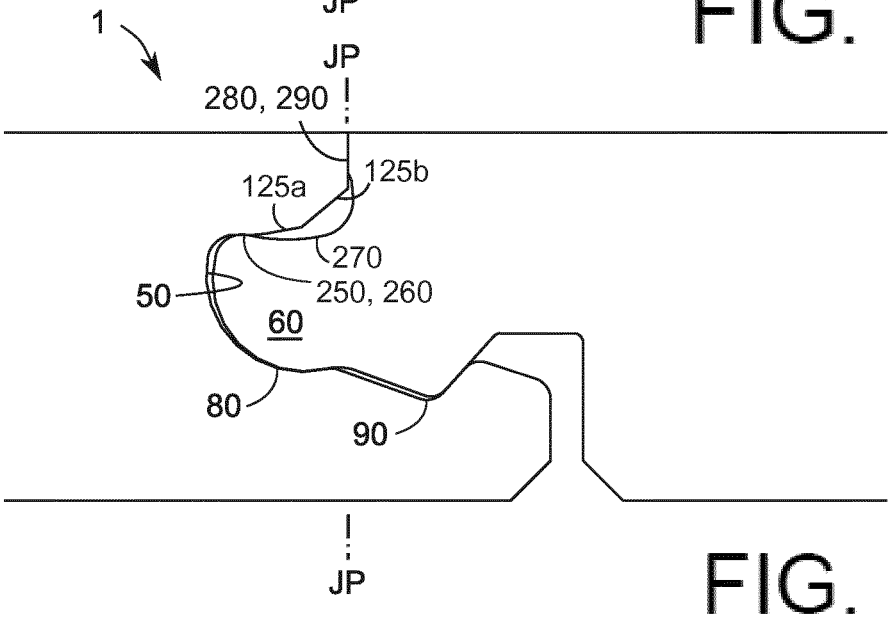
FIG. 11 is a side view of two joined floor panels of a fourth optional embodiment of the invention.

FIGS. 10 and 11 are side views of two joined floor panels of a third and fourth optional embodiment of the invention. Again, the figures are drawn with emphasized contour lines and without cross-sectional markings for the sake of clarity. The embodiments shown in FIGS. 10 and 11 are compatible with the other embodiments of this disclosure, and most features and functions are shared with the other embodiments. The following description will thus focus on the differing features. In the embodiments shown in FIGS. 10 and 11, the groove 50 comprises a stepped inclined introduction guiding chamfer, forming a first inclined introduction guiding chamfer 125*a* and a second inclined introduction chamfer 125*b*. The second inclined introduction guiding chamfer 125*b* is arranged closer to the vertical joint plane JP and is steeper, i.e. closer to a vertical angle, than the inclined introduction guiding chamfer 125*a* that is arranged further into the groove 50. The stepped inclined introduction chamfers 125*a*, 125*b* facilitates assembly of the floor panels. Furthermore, it is beneficial in terms of manufacturing as tool access is improved. The vertical locking surface 260 of the groove 50 is arranged inside of and adjacent to the first inclined guiding chamfer 125*a* in the groove 50.

The upper side of the tongue 60 may be concavely shaped, as shown in FIGS. 10 and 11, with a recess 270 having at least it deepest portion arranged at a lower vertical position than that of the vertical locking surface 250 on the tongue 60. Preferably is the curvature of the upper side of the tongue 60 arranged such that is merges smoothly and transitions from the concave recess 270 to the convex vertical locking surface 260. The rounded, convex shape of the vertical locking surface 250 in turn preferably merges into the curvature of the first locking lug 130. Preferably is the deepest portion of the recess arranged on the tongue 60 such that it will be located inside of the joint plane JP in the groove 50 when the floor panels 1 are connected to each other. The rounded convex shape of the vertical locking surface 250 provides a resilient locking at least partly attributed to the deformation of the vertical locking surface 250 by the contact forces between the tongue 60 and the groove 50. The vertical locking surface 250 on the tongue 60 will be at least elastically deformed upon assembly by its contact with the vertical locking surface 260 in the groove 50, improving the locking of the floor panels and reducing the risk of gaps forming and/or sounds such as squeaking being emitted due to movement between the floor panels. The rounded convex shape of the vertical locking surface 250 is also beneficial in terms of manufacturing tolerance uptake, as it allows elasticity in the material to absorb tolerances better than a flat shape. The recess 270 further improves the elasticity or resilience in the tongue 60 as a whole, allowing the tongue 60 to provide an improved tension or preload to the joint between the floor panels 1. The recess 270 further facilitates insertion of the tongue 60 into the groove 50.

As is illustrated in the embodiments of FIG. 10 and FIG. 11, the elasticity of the joint between the floor panels can be controlled by adjusting the depth of the groove 60 (i.e. the length L1 of the internally extending portion 100) and the corresponding protrusion of the tongue 50. The embodiment shown in FIG. 11 comprises a more shallow groove 60 and a shorter tongue 50 than that of FIG. 10, and is thus more rigid given that materials of the floor panels 1 etc. are the same. The shallower groove 60 is beneficial in that the lever arm effect of a vertical force applied above the groove 60 and close to the joint plane JP (to the left of the joint plane JP in FIG. 11) will be less significant, compared to that of FIG. 10. I.e., the embodiment shown in FIG. 11 may be beneficial for applications where the joints between the floor panels 1 may be subjected to high loads, as higher loads can be tolerated without risking that the joints between the floor panels 1 become vertically offset due to deformation and thus subjected to increased wear.

In addition, the embodiment shown in FIG. 11 may comprise a first 280 and second contact surface 290 arranged on opposite sides 30, 40 of the floor panel 1, the first and second contact surfaces 280, 290 being arranged to come into contact with each other when the floor panels 1 are assembled and form additional horizontal locking surfaces. The first and second contact surfaces 280, 290 are preferably vertically oriented and parallel to each other such that forces in the joint between the floor panels 1 are distributed over a larger surface area.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

It is to be understood that the present invention is not limited to the embodiments described above and illustrated in the drawings and a skilled person will recognize that many changes and modifications may be made within the scope of the appended claims.

The invention claimed is:

1. A joining system for floor panels, said floor panels comprising coupling parts on at least two opposite sides for joining floor panel together, said coupling parts including a groove and a tongue, where the groove is shaped for insertion of the tongue of an adjoining floor panel, said tongue of the adjoining floor panel being shaped for locking engagement with the groove in a direction perpendicular to said sides and parallel to a horizontal floor plane defined by the joined panels, said coupling parts exerting a tension force towards each other in a mutually engaged position, the tension force being achieved by elastic compression of the material of the coupling parts, locking means for locking the tongue of the adjoining floor panel within the groove, wherein the locking means comprises dual consecutive locking recesses arranged in a lower portion of the groove, a first locking recess located in an internally extending portion within the groove and a second locking recess located in a lip portion protruding from an entrance opening of the groove, the locking means further comprises dual consecutive locking lugs arranged in a lower portion of the tongue for horizontally interlocking engagement in the groove, a first locking lug extending downwardly from a lower tip portion of the tongue and a second locking lug extending downwardly from a root portion of the tongue, the first locking recess and the first locking lug are provided with matching curved horizontal locking surfaces and the second locking recess and the second locking lug are provided with matching inclined horizontal locking surfaces.

2. The joining system for floor panels according to claim 1, wherein an intermediate transitional ridge between the first locking lug and the second locking lug is located inside of the entrance opening of the groove, said entrance opening being located in a main vertical joint plane between two joined floor panels.

3. The joining system for floor panels according to claim 1, wherein an intermediate transitional ridge between the first locking lug and the second locking lug is aligned with the entrance opening of the groove, said entrance opening being located in a main vertical joint plane between two joined panels.

4. The joining system for floor panels according to claim 3, the intermediate transitional ridge having a height measured from a bottom plane of the floor panel and a corresponding inlet ridge of the second locking recess having a height, the height of the intermediate transitional ridge being equal to or less than the height of an inlet ridge of the second locking recess.

5. The joining system for floor panels according to claim 1, wherein the lower tip portion of the tongue is curved.

6. The joining system for floor panels according to claim 5, wherein the curvature of the curved lower tip portion of the tongue merges continuously with a corresponding curvature of the horizontal locking surface of the first locking lug.

7. The joining system for floor panels according to claim 1, wherein the first locking recess is shallower than the second locking recess.

8. The joining system for floor panels according to claim 1, wherein the the first locking recess extends downwardly to a depth and the second locking recess extends downwardly to a depth, the depth of the first locking recess is less than half of the depth of the second locking recess.

9. The joining system for floor panels according to claim 1, wherein an exit tangent inclination angle of the curved horizontal locking surface of the first locking recess is less than the inclined locking angle of the second locking recess.

10. The joining system for floor panels according to claim 9, wherein said exit tangent inclination angle of the curved horizontal locking surface of the first locking recess is equal to or less than half the inclined locking angle of the second locking recess.

11. The joining system for floor panels according to claim 1, wherein the curved horizontal locking surface extends from a point located essentially directly below a radial center of the curved first locking recess in a direction towards the second locking recess.

12. The joining system for floor panels according to claim 1, wherein the of tongue includes a vertical locking surface having a length and the groove includes a vertical locking surface having a length, the vertical locking surface of the tongue being less than the length of the vertical locking surface of the groove.

13. The joining system for floor panels according to claim 1, wherein a minimum thickness between the first locking recess and a bottom plane of the of the floor panel exceeds a third of the total height of the floor panel.

14. The joining system for floor panels according to claim 1, wherein the groove includes an introduction angle, the introduction angle of the groove being equal to or greater than 10 degrees.

15. The joining system for floor panels according to claim 1, wherein the length of the internally extending portion within the groove is less than the length of the lip portion protruding from an entrance opening of the groove.

* * * * *